US007152684B2

(12) United States Patent
Harrall et al.

(10) Patent No.: US 7,152,684 B2
(45) Date of Patent: Dec. 26, 2006

(54) TUBULAR HANGER AND METHOD OF LINING A DRILLED BORE

(75) Inventors: Simon John Harrall, Inverurie (GB); Paul David Metcalfe, Peterculter (GB); Paul Antony Rennison, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 261 days.

(21) Appl. No.: 10/326,474

(22) Filed: Dec. 20, 2002

(65) Prior Publication Data

US 2003/0127225 A1 Jul. 10, 2003

(30) Foreign Application Priority Data

Dec. 22, 2001 (GB) ..... 0130849.3

(51) Int. Cl.
*E21B 43/10* (2006.01)
*E21B 33/14* (2006.01)

(52) U.S. Cl. ..... 166/380; 166/285; 166/381; 166/206

(58) Field of Classification Search ..... 166/285, 166/208, 380, 382, 297, 55.1, 212, 206, 381
See application file for complete search history.

(56) References Cited

U.S. PATENT DOCUMENTS

| | | | | |
|---|---|---|---|---|
| 761,518 | A | 5/1904 | Lykken | |
| 1,233,888 | A | 7/1917 | Leonard | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,880,218 | A | 10/1932 | Simmons | |
| 1,930,825 | A | 10/1933 | Raymond | |
| 2,383,214 | A | 8/1945 | Prout | |
| 2,499,630 | A | 3/1950 | Clark | |
| 2,627,891 | A | 2/1953 | Clark | |
| 2,663,073 | A | 12/1953 | Bieber et al. | |
| 2,734,580 | A * | 2/1956 | Layne | 166/277 |
| 2,898,971 | A | 9/1959 | Hempel | |
| 3,087,546 | A | 4/1963 | Wooley | |
| 3,188,850 | A | 6/1965 | Linthicum et al. | |

(Continued)

FOREIGN PATENT DOCUMENTS

| | | |
|---|---|---|
| CA | 2356130 | 6/2000 |

(Continued)

OTHER PUBLICATIONS

PCT Search Report, International Application No. PCT/GB 02/05830, dated Aug. 12, 2003.

(Continued)

*Primary Examiner*—David Bagnell
*Assistant Examiner*—Shane Bomar
(74) *Attorney, Agent, or Firm*—Patterson & Sheridan, L.L.P.

(57) ABSTRACT

A method of lining a drilled bore comprises running an expandable first tubular into a bore and locating a portion of the first tubular in an unlined section of the bore and another portion of the first tubular overlapping a portion of an existing second tubular. The first tubular is secured relative to the second tubular while retaining the provision of fluid outlets to permit displacement of fluid from an annulus between the first tubular and the bore wall. An expansion device is then run through the first tubular to expand the first tubular to a larger diameter. Cement is then circulated into the annulus between the expanded first tubular and the bore wall. The fluid outlets are then closed.

34 Claims, 5 Drawing Sheets

U.S. PATENT DOCUMENTS 3,195,646 A 7/1965 Brown
3,353,599 A 11/1967 Swift
3,412,565 A 11/1968 Lindsey et al.
3,467,180 A 9/1969 Pensotti
3,529,667 A 9/1970 Malone
3,669,190 A 6/1972 Sizer et al.
3,785,193 A * 1/1974 Kinley et al. ..... 72/393
3,818,734 A 6/1974 Bateman
3,911,707 A 10/1975 Minakov et al.
4,069,573 A 1/1978 Rogers, Jr. et al.
4,127,168 A 11/1978 Hanson et al.
4,159,564 A 7/1979 Cooper, Jr.
4,288,082 A 9/1981 Setterberg, Jr.
4,311,194 A 1/1982 White
4,324,407 A 4/1982 Upham et al.
4,393,931 A 7/1983 Muse et al.
4,429,620 A 2/1984 Burkhardt et al.
4,531,581 A 7/1985 Pringle et al.
4,588,030 A 5/1986 Blizzard
4,697,640 A 10/1987 Szarka
4,848,462 A 7/1989 Allwin
4,848,469 A 7/1989 Baugh et al.
4,862,966 A 9/1989 Lindsey et al.
5,014,779 A 5/1991 Meling et al.
5,027,894 A 7/1991 Coone et al.
5,048,612 A 9/1991 Cochran
5,083,608 A * 1/1992 Abdrakhmanov et al. .... 166/55
5,086,845 A 2/1992 Baugh
5,181,570 A 1/1993 Allwin et al.
5,220,959 A 6/1993 Vance, Sr.
5,228,959 A 7/1993 Vance, Sr.
5,271,472 A 12/1993 Leturno
5,297,633 A 3/1994 Snider et al.
5,409,059 A 4/1995 McHardy
5,435,400 A 7/1995 Smith
5,467,826 A 11/1995 Miller
5,472,057 A 12/1995 Winfree
5,494,106 A 2/1996 Gueguen et al.
5,560,426 A 10/1996 Trahan et al.
5,685,369 A 11/1997 Ellis et al.
5,695,008 A 12/1997 Bertet et al.
5,785,120 A 7/1998 Smalley et al.
5,833,001 A 11/1998 Song et al.
5,901,787 A 5/1999 Boyle
5,918,677 A 7/1999 Head
6,021,850 A 2/2000 Wood et al.
6,056,536 A 5/2000 Schad et al.
6,065,536 A 5/2000 Gudmestad et al.
6,073,692 A 6/2000 Wood et al.
6,085,838 A 7/2000 Vercaemer et al. ..... 166/277
6,098,717 A 8/2000 Bailey et al.
6,253,850 B1 7/2001 Nazzai et al.
6,321,847 B1 11/2001 Brown
6,325,148 B1 * 12/2001 Trahan et al. ..... 166/297
6,352,112 B1 * 3/2002 Mills ..... 166/277
6,425,444 B1 7/2002 Metcalfe et al. ..... 166/387
6,431,282 B1 * 8/2002 Bosma et al. ..... 166/288
6,446,323 B1 9/2002 Metcalfe et al.
6,446,724 B1 9/2002 Baugh et al. ..... 166/285
6,454,013 B1 9/2002 Metcalfe
6,457,532 B1 10/2002 Simpson ..... 166/380
6,457,533 B1 10/2002 Metcalfe
6,497,289 B1 * 12/2002 Cook et al. ..... 166/380
6,527,049 B1 3/2003 Metcalfe et al.
6,543,552 B1 4/2003 Metcalfe et al.
6,543,816 B1 4/2003 Noel
6,578,630 B1 * 6/2003 Simpson et al. ..... 166/55.8
6,598,677 B1 * 7/2003 Baugh et al. ..... 166/285
6,648,075 B1 * 11/2003 Badrak et al. ..... 166/381
6,662,876 B1 * 12/2003 Lauritzen ..... 166/380
6,702,029 B1 3/2004 Metcalfe et al.
6,712,401 B1 3/2004 Coulon et al.
6,742,606 B1 * 6/2004 Metcalfe et al. ..... 175/57
2001/0020532 A1 9/2001 Baugh et al.
2003/0047320 A1 3/2003 Badrak et al.
2003/0127774 A1 7/2003 Stephenson et al.
2003/0183395 A1 10/2003 Jones
2004/0031530 A1 * 2/2004 Duggan ..... 138/98
2004/0055754 A1 * 3/2004 MacKay et al. ..... 166/380
2004/0123983 A1 * 7/2004 Cook et al. ..... 166/50
2005/0000697 A1 * 1/2005 Simpson et al. ..... 166/380
2005/0023001 A1 * 2/2005 Hillis ..... 166/380
2006/0054330 A1 * 3/2006 Ring et al. ..... 166/380

FOREIGN PATENT DOCUMENTS

EP 0 961 007 A2 12/1999
GB 2 320 734 7/1998
GB 2 326 896 A 1/1999
GB 2 344 606 6/2000
GB 2 344 606 A 6/2000
GB 2 345 308 7/2000
GB 2 347 950 9/2000
GB 2 347 952 9/2000
GB 2350137 A * 11/2000
GB 2 382 605 6/2003
WO 93/25799 12/1993
WO WO 93/24728 12/1993
WO WO 97/06346 2/1997
WO WO 99/18328 4/1999
WO WO 99/23354 5/1999
WO 99/35368 7/1999
WO 00/37766 6/2000
WO 02/25056 A1 3/2002
WO WO 02/081863 A1 * 10/2002
WO WO 03/006788 1/2003

OTHER PUBLICATIONS

U.S. Appl. No. 10/794,790, filed Mar. 5, 2004, Carter et al.
UK Search Report, Application No. GB0415000.9, dated Sep. 6, 2004.
GB Search Report, Application No. GB0315997.7, dated Oct. 22, 2003.
CA Office Action, Application No. 2,471,336, Dated May 19, 2006.

* cited by examiner

Embodiment 2
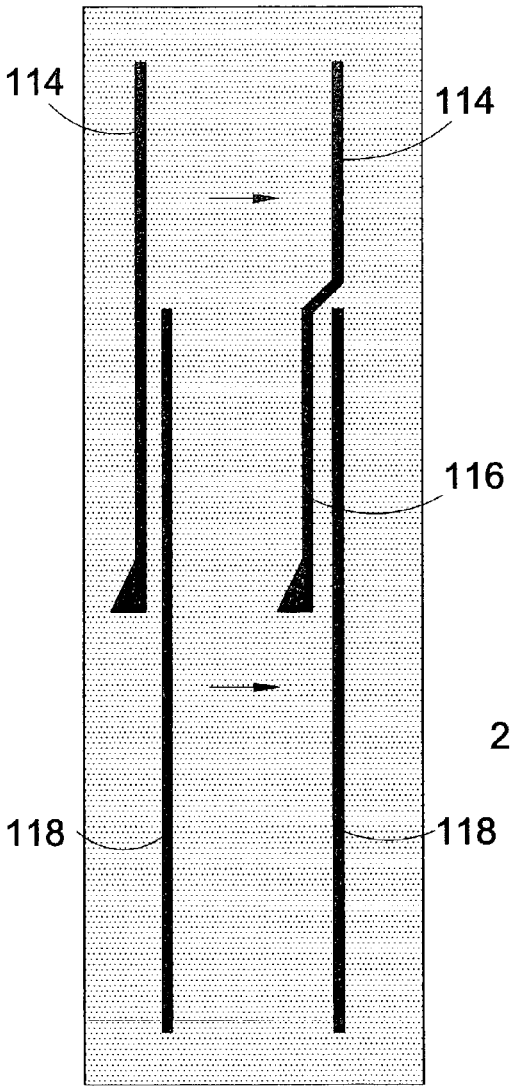
Embodiment 3
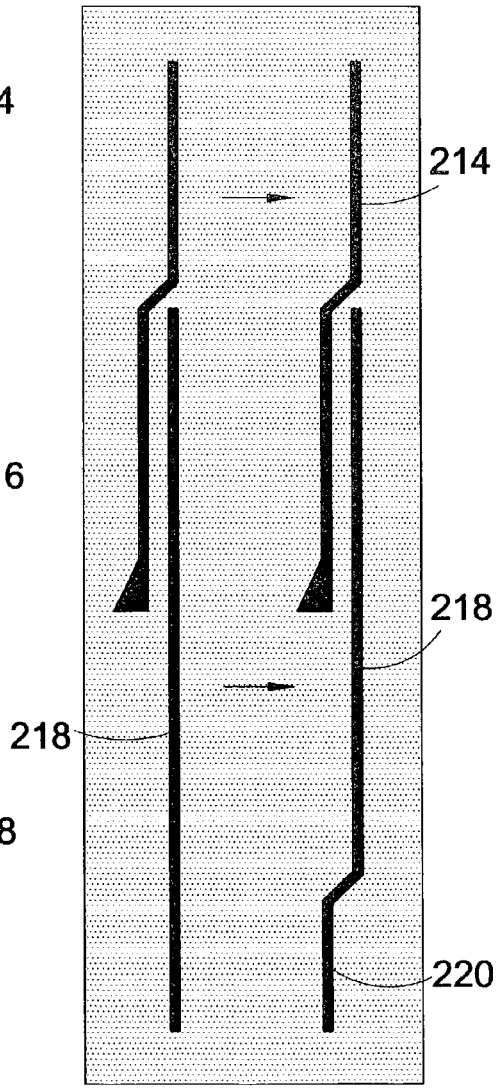
Fig.9 Fig.10 Fig.11 Fig.12

TUBULAR HANGER AND METHOD OF LINING A DRILLED BORE

FIELD OF THE INVENTION

This invention relates to bore liner, and in particular to expandable bore liner.

BACKGROUND OF THE INVENTION

Recent developments in the oil and gas exploration and extraction industries have included the provision of expandable bore-lining tubing. One such system proposes expandable bore liner being run into a section of open hole, below a cased section of bore, such that the upper end of the liner overlaps with the lower end of the existing casing, as described in GB 2 344 606 A. The lower end of the liner is anchored in the bore, and cement slurry is circulated into the annulus between the liner and the bore wall, displaced fluid from the annulus passing through the gap between the lower end of the casing and the upper end of the unexpanded liner. The liner is run into the bore with an expansion cone or swage located at the lower end of the liner and, once the cement slurry is in place, the expansion cone is urged upwardly through the liner, by supplying hydraulic fluid at an elevated pressure behind the cone. This expands the liner to a larger inner and outer diameter, and brings the outer face of the upper end of the liner into contact with the inner face of the lower end of the casing. The cement then cures, sealing and securing the expanded liner in the bore.

There are however a number of potential difficulties associated with this proposal. Firstly, as cementation takes place prior to expansion, there is a risk that the cement will set before expansion has been initiated or completed.

Further, the expansion cone moves upwardly from the lower end of the liner, such that any expansion problems may result in the cone becoming stuck part way through the liner. Access to remedy the problem is then restricted by the presence of the cone and the smaller diameter unexpanded liner above the cone.

Circumferential expansion of the liner using a cone results in axial shrinkage of the liner. Thus, difficulties may be experienced if the liner becomes differentially stuck in the bore, that is if there is a differential pressure between the bore and a formation intersected by the bore, and this pressure differential acts on the liner to hold the liner against a portion of the bore wall. The axial shrinkage of the liner will thus be resisted between the differentially stuck portion of the liner and the anchor at the lower end of the liner. This may result in the liner breaking, or in the expansion process being curtailed with the cone only part-way through the liner.

The use of pressure to urge the cone through the liner relies upon the maintenance of pressure integrity below the cone. Connections between liner sections will be subject to expansion, and should a connection leak following expansion, the expansion process may be hindered or halted. Furthermore, a sudden failure of a connection may expose the surrounding formation to undesirable elevated pressure, potentially damaging the formation and impacting on its production capabilities. Furthermore, if the formation is fractured, there may a loss of fluid into the formation, with the associated expense and inconvenience, and potential for damage to the formation.

Furthermore, the use of hydraulic pressure to urge the cone upwardly through the liner relies upon the provision of a pressure-tight seal between the cone and the liner, and thus requires the liner to conform to tight tolerances on the liner internal diameter, wall thickness and roundness. These tolerances are much tighter than standard API specifications, and consequently make manufacture of such liner relatively expensive.

Finally, when expanding a liner overlapping an existing casing utilising a cone or swage it is only possible to expand the liner to a diameter smaller than the casing, such that any further sections of liner must be of still smaller diameter.

It is among the objectives of embodiments of the present invention to obviate or mitigate these and other disadvantages of existing liner expansion proposals.

SUMMARY OF THE INVENTION

According to a first aspect of the present invention there is provided a method of lining a drilled bore, the method comprising:

- running an expandable first tubular of an external first diameter into a bore;
- locating the first tubular in an unlined section of the bore with an upper end of the first tubular overlapping a lower end of an existing second tubular of an internal second diameter larger than said first diameter;
- securing the upper end of the first tubular relative to the lower end of the second tubular while retaining fluid outlets to permit displacement of fluid from an annulus between the first tubular and the bore wall;
- running an expansion device down through the first tubular to expand the first tubular to a larger diameter;
- circulating cement into the annulus between the expanded first tubular and the bore wall;
- sealing the upper end of the first tubular to the lower end of the second tubular.

Expanding the first tubular prior to cementation avoids any problems relating to the cement setting prior to expansion. Furthermore, as the expansion is carried out "top down", if any difficulties are experienced the expansion device is relatively easily accessed.

In other aspects of the invention it is not necessary to cement the liner in place, for example the liner may be expanded to conform to the surrounding bore wall, or the liner may carry or be provided with a sleeve of deformable or expanding material, such as an elastomer which may be formulated to swell on exposure to selected fluids or temperatures.

Preferably, the first tubular is expanded by rotary or rolling expansion, that is an expansion device featuring one or more rotatable expansion members, the device being rotated within the tubular as the device is axially advanced there through. Examples or such rotary expansion devices are described in applicant's WO00\37766 and U.S. Ser. No. 09\469,690, the disclosures of which are incorporated herein by reference. Such expansion devices operate using a different expansion mechanism than cones and swages, that is by reducing the wall thickness of the tubular and thus increasing the diameter of the tubular, rather than simple circumferential extension of the tubular wall. Such devices may be controlled to limit the degree of axial shrinkage or contraction of the tubular during expansion, and thus the impact of any differential sticking is reduced, and the different yield mechanism of rotary expansion is also better able to accommodate localised differential sticking. The rotary expansion device may be compliant, that is be capable of expanding a variable diameter, or of fixed diameter. However, in certain embodiments of the invention, expansion cones or swages may still be utilised to expand the first tubular, or an axial compliant expander may be utilised, such as the tool sold under the ACE trade mark by the applicant, or the tool as described in the PCT and United States patent applications filed on 30 Nov. 2002, based on applicant's UK patent application 0128667.3.

The first tubular may be expanded by a combination of mechanical and hydraulic means, as described in applicant's PCT patent application WO02\081863.

Preferably, the upper end of the first tubular is expanded to an internal diameter sufficient such that there is little or no reduction in internal diameter between the second tubular and the expanded first tubular. This may be achieved in a number of ways. The lower end portion of the second tubular may describe a larger diameter than an upper portion of the tubular, to create a "bell-end" or the like, such that the first tubular may be expanded into the bell-end. Alternatively, the upper end of the first tubular may be expanded within the lower end of the second tubular and induce expansion and deformation of the second tubular.

Preferably, the upper end of the first tubular is expanded to secure the upper end of the first tubular relative to the lower end of the second tubular. Most preferably, the upper end of the first tubular is further extended to seal the upper end of the first tubular to the lower end of the second tubular.

The lower end of the first tubular may be expanded to a larger internal diameter, to accommodate the upper end of a subsequent tubular.

Preferably, the first tubular is liner and the second tubular is casing.

BRIEF DESCRIPTION OF THE DRAWINGS

These and other aspects of the present invention will now be described, by way of example, with reference to the accompanying drawings, in which:

FIGS. 9 and 10 are schematic illustrations of steps in the process of lining a bore in accordance with a second embodiment of the present invention; and FIGS. 11 and 12 are schematic illustrations of steps in the process of lining a bore in accordance with a third embodiment of the present invention.

DETAILED DESCRIPTION OF THE DRAWINGS

Reference is first made to FIGS. 1 to 7 of the drawings, which are schematic illustrations of steps in the process of lining a drilled bore in accordance with a preferred embodiment of the present invention.

Figures 1, 2, 3, 4, 5, 6, 7:
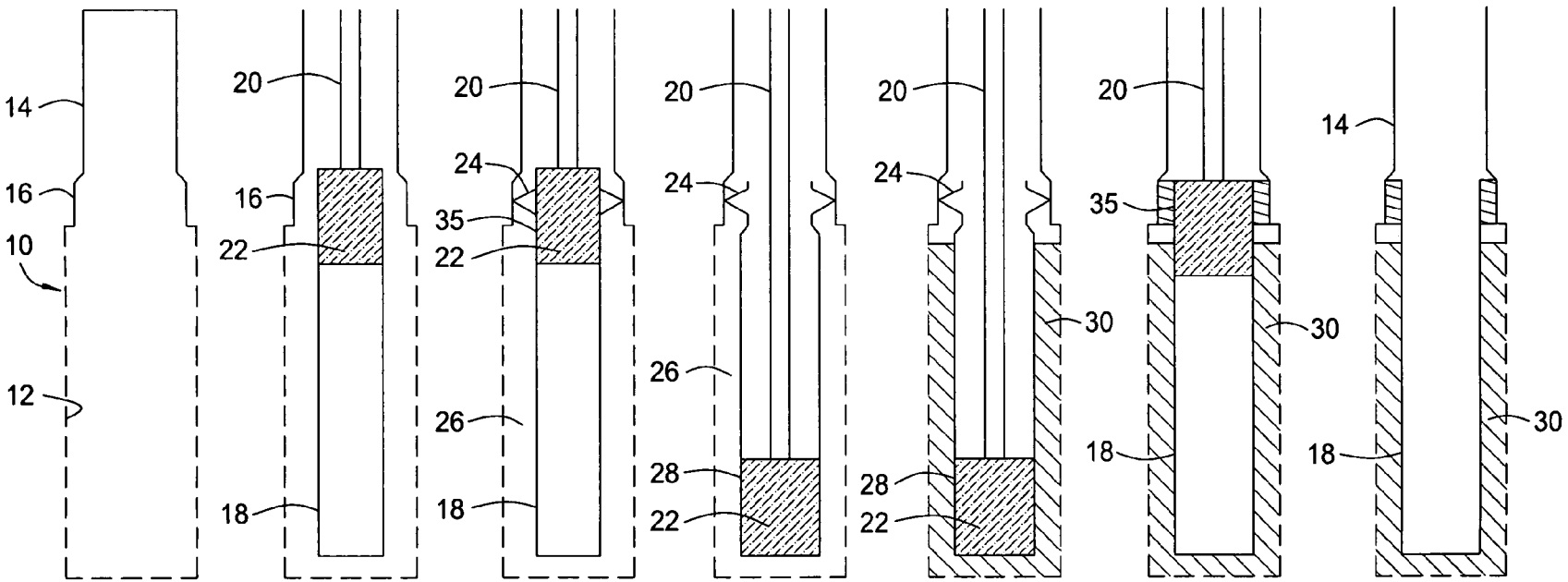
FIGS. 1 to 7 are schematic illustrations of steps in the process of lining a bore in accordance with a preferred embodiment of the present invention.
Figure 8A:
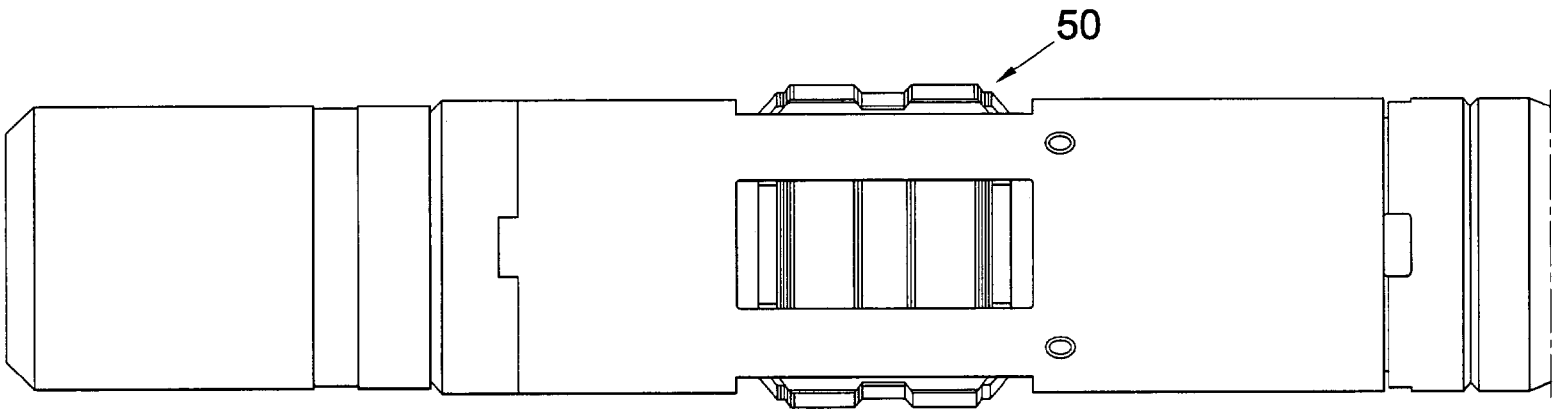
FIG. 8 shows a setting tool suitable for use in the process of FIGS. 1 to 7.
Figure 8B:
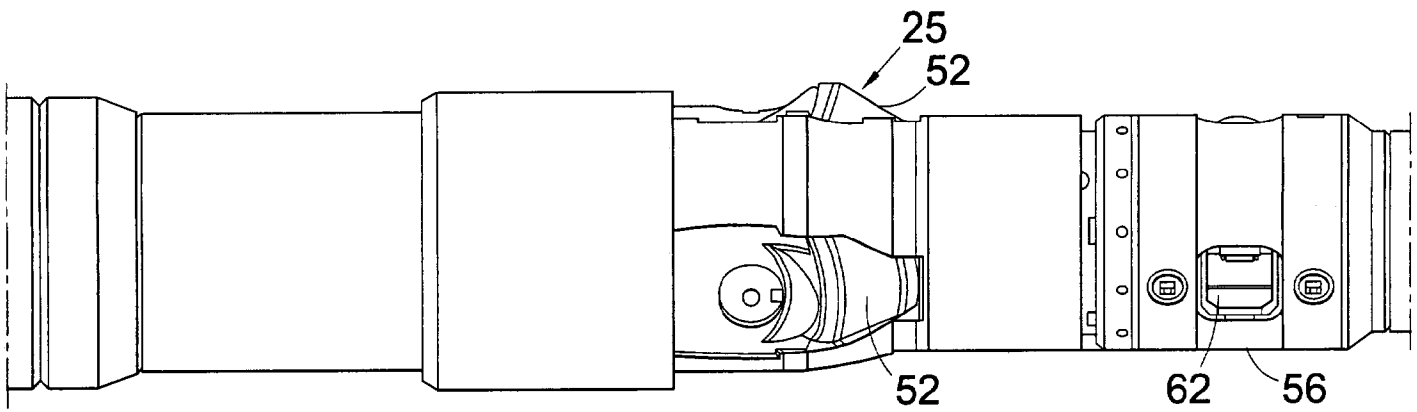
Figure 8C:
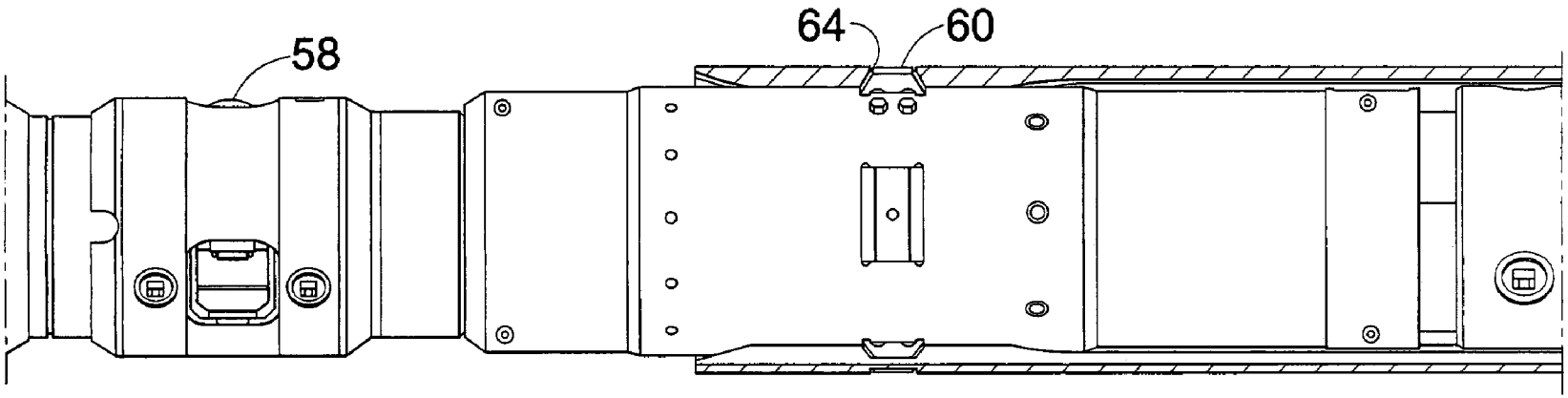
Figure 8D:
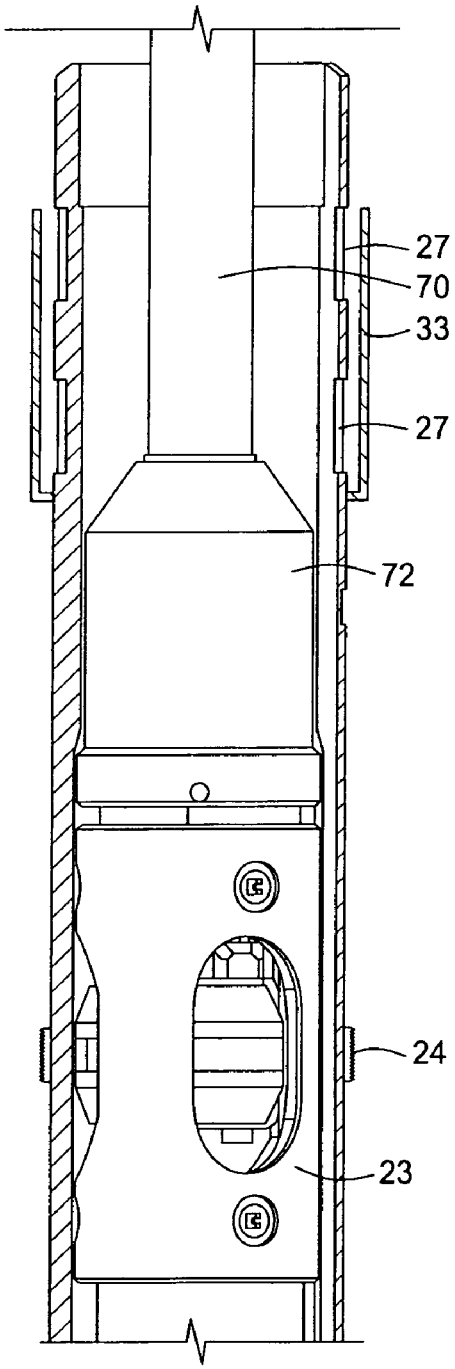
Figure 8E:
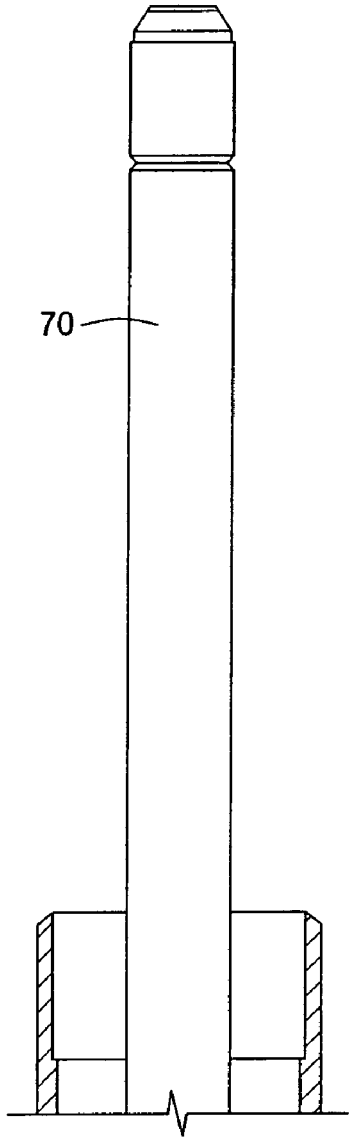

FIG. 1 of the drawings illustrates the lower end of a bore 10 including an open or unlined bore section 12. Above the unlined section 12, the bore 10 has been lined with casing 14, which has been sealed relative to the adjacent bore wall using conventional cementation techniques. It will be noted that the lower end of the casing 14 features a larger diameter end section 16, or bell-end.

FIG. 2 shows a section of expandable liner 18 which has been run into the bore 10 on an appropriate running string 20. The liner 18 is initially coupled to the running string 20 via a setting tool 22 (the tool 22 will be described in greater detail below, following the description of the process, with reference to FIG. 8 of the drawings). The liner 18 is run into the bore 10 on the string 20 and located in the bore such that the upper end of the liner 18 overlaps the larger diameter casing end section 16.

The setting tool 22 includes a fluid pressure actuated compliant rolling expansion device 23 which is rotatably coupled to the string 20 but which is rotatable relative to the setting tool 22 and liner 18. When actuated and rotated, the expansion device 23 extends at least a portion of the upper end of the liner 18 into contact with the casing end section 16, thus providing an anchor 24 for the liner 18. An axial push and pull is then applied to the tool 22 from surface to ensure that the liner 18 is firmly anchored to the casing 14. The setting tool 22 is then released from the now anchored liner 18 and the compliant rolling expansion device 23 utilised to expand the section of liner 18 above the anchor 24, to locate the liner 18 more securely relative to the casing 14. At this stage, an elastomeric seal sleeve 35 below the anchor 24 remains inactive, and a number of fluid ports 27 in the liner remain open to allow fluid to pass from the annulus 26 between the liner 18 and the bore wall between the overlapping ends of the casing 14 and liner 18.

Next, as illustrated in FIG. 4, the setting tool 22 is moved downwardly through the liner 18 and a fixed diameter expansion device 25 is utilised to expand the liner 18 to a larger diameter, such that the expanded inner diameter of the liner 18 corresponds to the inner diameter of the casing 14. The expansion of the liner 18 is achieved using a rolling expansion device 25 but may equally feature one or both of fixed and compliant rolling elements. If compliant rolling elements are present, these are actuated to extend radially outwardly of the tool body by hydraulic pressure supplied to the tool 22 via the running string 20.

The lower end of the liner 18 is provided with an expandable drillable float shoe 28, of a suitable material such a composite or aluminium alloy. The shoe 28 incorporates a float collar with a flapper valve, and the check valves normally found in a shoe. On the setting tool 22 encountering the float shoe 28, a sealed connection is formed with the float collar, the flapper valve is opened and a cement port in the setting tool 22 is opened, such that cement slurry may be pumped down the running string 20, through the setting tool 22, through the float shoe 28, and into the annulus 26, as illustrated in FIG. 5. The fluid from the annulus displaced by the cement 30 passes through the flow ports 27 in the liner 18 below the anchor 24.

Once cementation is completed, the setting tool 22, with the compliant expansion device 23 retracted, is pulled out of the lower end of the expanded liner 18 and the flapper valve in the float shoe closes. Cleaning fluid is then circulated through the liner 18 and casing 14, via the tool 22, to clean out any remaining cement residue. The compliant expansion device 23 is then pulled out until the device 23 is located adjacent the liner seal 35. The expansion device 23 is then actuated to further expand the upper end of the liner 18 into contact with the surrounding casing 14 to activate the seal 35 and close the liner flow ports 27, and thus form a fluid seal between the liner 18 and the casing 14. The setting tool 22 is then pulled out of the bore 10.

As noted above, in this embodiment the casing 14 is provided with a larger diameter lower end section 16, into which the upper end of the liner 18 is expanded, such that the expanded liner 18 has the same internal diameter as the casing 14. For example, 7 inch liner 18 may be run through a 9 inch casing 14. The 7 inch liner 18 may then be expanded to provide the same internal dimensions as the 9 inch liner.

Reference is now made to FIG. 8 of the drawings, which illustrates details of a setting tool 22 as may be utilised in the above-described method. The tool 22 will be described from the top down, starting with FIG. 8*a*.

The upper end of the tool 22 extends above the upper end of the liner 18 and features a location device in the form of a spring-loaded latch 50 which is shaped to locate in a profile (not shown) provided in the lower end of the casing 14. This serves to indicate when the tool 22, and thus the liner 18, has been correctly located relative to the casing 14; once the latch 50 has engaged the casing profile, an over-pull or additional weight is required to dislodge the latch 50 from the profile. The correct location of the tool 22 and the liner 18 in the casing 14 is important as, for example, if the overlap between the liner 18 and casing 14 is not as intended, it may not be possible to fully expand the liner 18, leaving a restriction in the liner bore. Of course the location device may take other forms, and may utilise sensors relaying signals to surface rather than relying on mechanical engagement.

Below the latch 50 is the fixed diameter expansion tool 25, which in this example features three rollers 52 mounted on inclined spindles. Mounted below the expansion tool 25 are a pair of torque anchors 56, 58, which are rotatably fixed relative to the arrangement for supporting the liner on the tool 22 (FIG. 8*c*), in the form of liner-supporting dogs 60, but which are mounted to the remainder of the tool 22 via a swivel. The anchors 56, 58 comprise rollers 62 which define circumferentially extending teeth. The rollers are mounted on pistons and are each rotatable about an axis which lies parallel to the axis of the tool 22 and the liner 18. The anchors 56, 58 may be hydraulically actuated to extend radially into contact with the inner surface of the casing 14.

The liner-supporting dogs 60 initially extend through windows 64 in the upper end of the liner 18, which will form the liner hanger. The dogs 60 may be released by application of an over-pressure within the tool 22. In this example such an over-pressure shears a disc which then creates an impulse pressure on a dog-supporting sleeve, to move the sleeve to a position in which the dogs may radially retract. However, in other embodiments the dogs may be released by some other means, for example by rotating the tool 22 to the left relative to the anchored liner 18.

The liner-supporting dogs 60 and the torque anchors 56, 58 operate in concert when the compliant expansion device 23 (FIG. 8*d*) is first activated; the elevated pressure utilised to activate the expansion device 23 also serves to activate the anchors 56, 58 to engage with the casing 14, such that when the activated device 23 is rotated to expand the anchor C-ring 24, the liner 18 is held stationary.

Following release of the dogs 60, by application of an over-pressure following activation of the anchor, the rollers 62 allow the actuated anchors 56, 58 to move upwardly relative to the casing 14 as the activated device 23 is utilised to expand the liner 18 above the anchor 24.

A cement stinger 70 (FIGS. 8*d* and 8*e*) is provided below the expansion device 23, and is mounted to the remainder of the lower end of the tool 22 via a swivel 72. Following expansion of the liner 18 the stinger 70 stabs into an appropriate pack-off bushing at the liner shoe 28 to allow cement to be pumped from surface into the annulus 26.

Following cementation and cleaning, as described above, the compliant expansion tool 23 is utilised to further expand the upper end of the liner, and in particular to activate the seal 35 and close the liner flow ports 27. This follows the tool 22 being accurately located relative the upper end of the liner 18 and the casing 14 by means of the latch 50.

Reference is now made to FIGS. 9 and 10 of the drawings, which illustrate an alternative arrangement, in which the casing 114 is initially of substantially constant diameter over its length. However, when the upper end of the liner 118 is expanded to provide a fluid-tight seal between the liner 118 and the casing 114, the lower end of the casing 116 is also subject to a degree of expansion, such that the upper end of the expanded liner 118 describes the same internal diameter as the unexpanded casing 114. To permit such expansion of the casing 114, it is of course necessary that the annulus around the lower end of the casing 114 is free of set cement or other incompressible materials. To this end, it is preferred that the casing has been provided with a shoe, such as described in applicant's PCT\GB01\04202, the disclosure of which is incorporated herein by reference, to retain the lower portion of the casing annulus free of cement.

In other embodiments, the lower end of the casing may be subject to little if any expansion, such that there is a small loss of diameter at the liner top.

Reference is now made to FIGS. 11 and 12 of the drawings, FIG. 11 showing liner 218 which has been expanded in a similar manner to the first described embodiment. However, the lower end of the liner 220 is then subject to further expansion, to facilitate accommodation of a further expanded liner, and such that the further expandable liner may be expanded to a similar internal diameter to the first expanded liner 218 and the existing casing 214. The expansion of the lower end of the liner may be achieved by means of a compliant expansion tool 23, as described above.

In other embodiments of the invention the cementation step may not be required, for example when the liner is provided with an elastomer on its outer face, which elastomer may be formulated to swell on contact with certain fluids to fill the annulus between the expanded liner and the bore wall. In still further embodiments, the cementation may be carried in stages, particularly when the liner is relatively long. In such a situation the expansion may also be carried out in stages, that is a section of liner is expanded and then cemented, and this process is then repeated as many times as is necessary for subsequent sections. Fluid circulation between the annulus and an intermediate section of the liner may be achieved by providing flow ports at appropriate points in the liner, which ports are adapted to be closed on expansion of the liner to a predetermined degree. In one embodiment, an exterior sleeve 33 is provided around the ports 27, allowing fluid to flow through the ports. However, when the liner is expanded the liner is brought into contact with the sleeve 33 and the sleeve closes the ports.

The invention claimed is:

1. A method of lining a drilled bore, the method comprising:

running an expandable first tubular into a bore;

locating a first portion of the first tubular in an unlined section of the bore and a second portion of the first tubular overlapping a portion of an existing second tubular;

securing the first tubular relative to the second tubular while retaining fluid outlets to permit displacement of fluid from an annulus between the first tubular and the bore wall;

running an expansion device through the first tubular to expand the first tubular to a larger diameter;

circulating cement into the annulus between the expanded first tubular and the bore wall;

displacing fluid from the annulus into an inner diameter of the first tubular through the fluid outlets; and closing the fluid outlets.

2. The method of claim 1, comprising:

providing flow ports at a location in the first tubular to provide for fluid passage from the annulus into the tubular.

3. The method of claim 2, further comprising expanding the tubular at said location to close the flow ports.

4. The method of claim 3, comprising expanding the tubular at said location into contact with the surrounding second tubular.

5. The method of claim 1, comprising running the expansion device down through the first tubular.

6. The method of claim 1, comprising locating a lower portion of the first tubular in an unlined section of the bore and an upper portion of the first tubular overlapping a lower portion of the second tubular.

7. The method of claim 1, comprising expanding the first tubular by rotary expansion.

8. The method of claim 1, comprising expanding the first tubular using an axial expander.

9. The method of claim 1, comprising expanding the first tubular utilising a compliant expander.

10. The method of claim 1, comprising expanding the first tubular utilising a fixed diameter expander.

11. The method of claim 1, comprising:

expanding the second portion of the first tubular using a variable diameter expansion device; and expanding the first portion of the first tubular using a fixed diameter expansion device.

12. The method of claim 1, wherein the second portion of the first tubular is expanded to an internal diameter corresponding to an internal diameter of the second tubular.

13. The method of claim 1, wherein a lower end of the second tubular describes a larger diameter than an upper portion of the second tubular, and the first tubular is expanded into said lower end of the second portion.

14. The method of claim 1, wherein the second portion of the first tubular is at least partially expanded to secure the first tubular relative to the second tubular.

15. The method of claim 14, wherein the second portion of the first tubular is further expanded to seal the first tubular to the second tubular.

16. The method of claim 1, wherein the first tubular is liner.

17. The method of claim 1, wherein the second tubular is casing.

18. The method of claim 1, wherein expansion of the first tubular is assisted by application of elevated fluid pressure.

19. The method of claim 1, further comprising positively locating the first tubular relative to the second portion before securing the first tubular relative to the second tubular.

20. The method of claim 1, further comprising expanding the first tubular in sections.

21. The method of claim 1, further comprising cementing the first tubular in sections.

22. The method of claim 1, further comprising:

running an expansion device through a first section of the first tubular to expand said first section to a larger diameter;

circulating cement into a first section of the annulus between the expanded first section and the bore wall.

23. The method of claim 22, further comprising:

running an expansion device through a second section of the first tubular to expand said second section to a larger diameter;

circulating cement into a second section of the annulus between the expanded second section and the bore wall.

24. A method of lining a drilled bore, the method comprising:

running an expandable first tubular into a bore;

running an expansion device through a first section of the first tubular thereby expanding the first section to a larger diameter;

circulating cement into the annulus between the first section and the bore wall, wherein the expanding the first section occurs prior to circulating cement into the annulus between the first section and the bore wall; and subsequently expanding and cementing further sections of the first tubular at different axial locations than the first section.

25. A method of lining a bore comprising:

running an expandable first tubular into a bore;

overlapping a portion of the first tubular with a second tubular located in the bore, the second tubular having a larger diameter portion for receiving said portion of the first tubular, the larger diameter portion of the second tubular having a larger inner diameter than a remaining portion of the second tubular; and expanding the first tubular by a combination of compliant and fixed diameter rotary expansion, wherein a first section of the first tubular is expanded only by the compliant rotary expansion and a second section of the first tubular is expanded by the fixed diameter rotary expansion.

26. A method of lining a drilled bore, the method comprising:

running an expandable first tubular of an external first diameter into a bore;

locating the first tubular in an unlined section of the bore with an upper end of the first tubular overlapping a lower end of an existing second tubular of an internal second diameter larger than said first diameter, the lower end having a larger inner diameter than a remainder of the second tubular;

securing the upper end of the first tubular relative to the lower end of the second tubular while retaining fluid outlets to permit displacement of fluid from an annulus between the first tubular and the bore wall;

running an expansion device down through the first tubular to expand the first tubular to a larger diameter;

displacing fluid through the fluid outlets from the annulus into an inner diameter of the first tubular; and sealing the upper end of the first tubular to the lower end of the second tubular.

27. The method of claim 26, wherein the first tubular is expanded into close contact with the surrounding bore wall.

28. The method of claim 26, wherein the first tubular is provided in combination with a sleeve of deformable material for contacting the surrounding bore wall.

29. The method of claim 26, wherein the first tubular is provided in combination with a sleeve of expanding material for contacting the surrounding bore wall.

30. The method of claim 29, wherein the sleeve of material comprises a swelling elastomer.

31. The method of claim 30, further comprising circulating fluid between the first tubular and the bore wall, the fluid being selected to interact with the elastomer and to induce swelling of the elastomer into sealing contact with the bore wall.

32. The method of claim 26, wherein expansion of the first tubular is assisted by application of elevated fluid pressure.

33. A method of lining a drilled bore, the method comprising:

running an expandable first tubular into a bore;

locating a first portion of the first tubular in an unlined section of the bore and a second portion of the first tubular overlapping a portion of an existing second tubular;

securing the first tubular relative to the second tubular while retaining fluid outlets to permit displacement of fluid from an annulus between the first tubular and the bore wall;

running an expansion device through the first tubular to expand the first portion of the first tubular to a larger diameter;

circulating cement into the annulus between the expanded first tubular and the bore wall; and closing the fluid outlets.

34. The method of claim 33, wherein securing the first tubular includes expanding the first tubular.

* * * * *